US006379203B1

(12) United States Patent
Kuo

(10) Patent No.: US 6,379,203 B1
(45) Date of Patent: Apr. 30, 2002

(54) SWIMMING FINS

(76) Inventor: Tzong-Fuh Kuo, No. 21, Alley 5, Lane 49, How Gaang 1st Rd., Hsing Juang City, Taipei Hsien (TW)

( * ) Notice: Subject to any disclaimer, the term of this patent is extended or adjusted under 35 U.S.C. 154(b) by 0 days.

(21) Appl. No.: 09/733,344

(22) Filed: Dec. 7, 2000

(51) Int. Cl.[7] ..... A63B 31/08
(52) U.S. Cl. ..... 441/64
(58) Field of Search ..... 441/61–64; 440/101; D21/806

(56) References Cited

U.S. PATENT DOCUMENTS 1,786,451 A * 12/1930 Ribard ..... 440/101
3,952,351 A * 4/1976 Gisbert ..... 441/64
5,746,631 A * 5/1998 McCarthy ..... 441/64

FOREIGN PATENT DOCUMENTS

IT 602027 * 2/1960 ..... 441/64

* cited by examiner

*Primary Examiner*—Jesus D. Sotelo
(74) *Attorney, Agent, or Firm*—Pro-Techtor International Services

(57) ABSTRACT

A unidirectional valve for a swimming fin has a valve seat configured to be integrally formed with a front portion of the fin and having a through hole defined through the front portion of the fin, multiple ribs radially extending inside the through hole from a joint of the ribs, an annular flange formed on an inner periphery defining the through hole and an opening defined in the joint of the ribs and a resilient-material-made disk detachably engaged with an underside of the flange of the valve seat to selectively seal the through hole and having a stub extending outward from the disk to correspond to the opening and a stop formed on top of the stub to detachably engage with a joint of the ribs to limit the travel of the disk. The unidirectional valve is able to assist the user to gain the necessary forward force when the user is paddling downward and reduces the water resistance when the user is paddling upward.

4 Claims, 4 Drawing Sheets

SWIMMING FINS

BACKGROUND OF THE INVENTION

1. Field of the Invention

The present invention relates to a pair of swimming fins, and more particularly to a pair of swimming fins each having a unidirectional valve mounted thereon, such that when the swimmer is peddling downward, the swimmer receives a forward thrust because the unidirectional valve is closed and when the swimmer is peddling upward, the swimmer receives less resistance from the water since the unidirectional valve is opened to allow the water to flow through the valve.

2. Description of Related Art

A pair of swimming fins is used to help the swimmer to move forward by paddling the swimmer's feet. With reference to FIG. 5, a conventional pair of swimming fins (100) has a gap (102) defined in a front portion (101) of the pair of fins (100) to reduce the strength of the swimmer while moving forward. The gap (102) does save energy for the swimmer, however, it causes the pair of fins to unevenly move while the swimmer is paddling the feet. Furthermore, the gap (102) causes the forward momentum insufficient so that the swimmer will have to move his/her feet rapidly to gain the required momentum, which easily causes fatigue to the swimmer and thus loses the design of the gap (102).

To overcome the shortcoming of the above mentioned swimming fins, another improved pair of swimming fins is introduced, as shown in FIG. 6. Each one of the swimming fins (200) has a closed front portion (201) so as to avoid the uneven movement of the fins while moving upward and downward by the swimmer's feet. Furthermore, each one of the fins (200) have a reinforced plate (202) formed on a mediate portion of the fins (200) so that the entire thickness of the fins (200) is able to be tapered to reduce the entire weight of the fins. The tapered thickness of the fins (200) also causes the fins (200) to move unevenly. It is concluded that although this kind of pair of fins does save the swimmer's energy while paddling, is causes the uneven movement of the fins, which causes the swimmer hard to control the moving direction.

To overcome the shortcomings, the present invention tends to provide an improved pair of fins to mitigate and obviate the aforementioned problems.

SUMMARY OF THE INVENTION

The main objective of the invention is to provide an improved pair of fins each of which has at least one unidirectional valve mounted thereon, so that when the swimmer's feet are paddling downward, the unidirectional valve is closed to help the swimmer to have the required forward momentum and when the swimmer's feet are paddling upward, the unidirectional valve is opened to allow the water to flow through the valve to reduce the resistance from the water so as to save energy of the swimmer.

Another objective of the invention is to have a cap on each one of the unidirectional valve so that the swimmer is able to adjust the water flowing through the pair of fins according to the swimmer's requirements.

Other objects, advantages and novel features of the invention will become more apparent from the following detailed description when taken in conjunction with the accompanying drawings.

DETAILED DESCRIPTION OF PREFERRED EMBODIMENT

Figure 1:
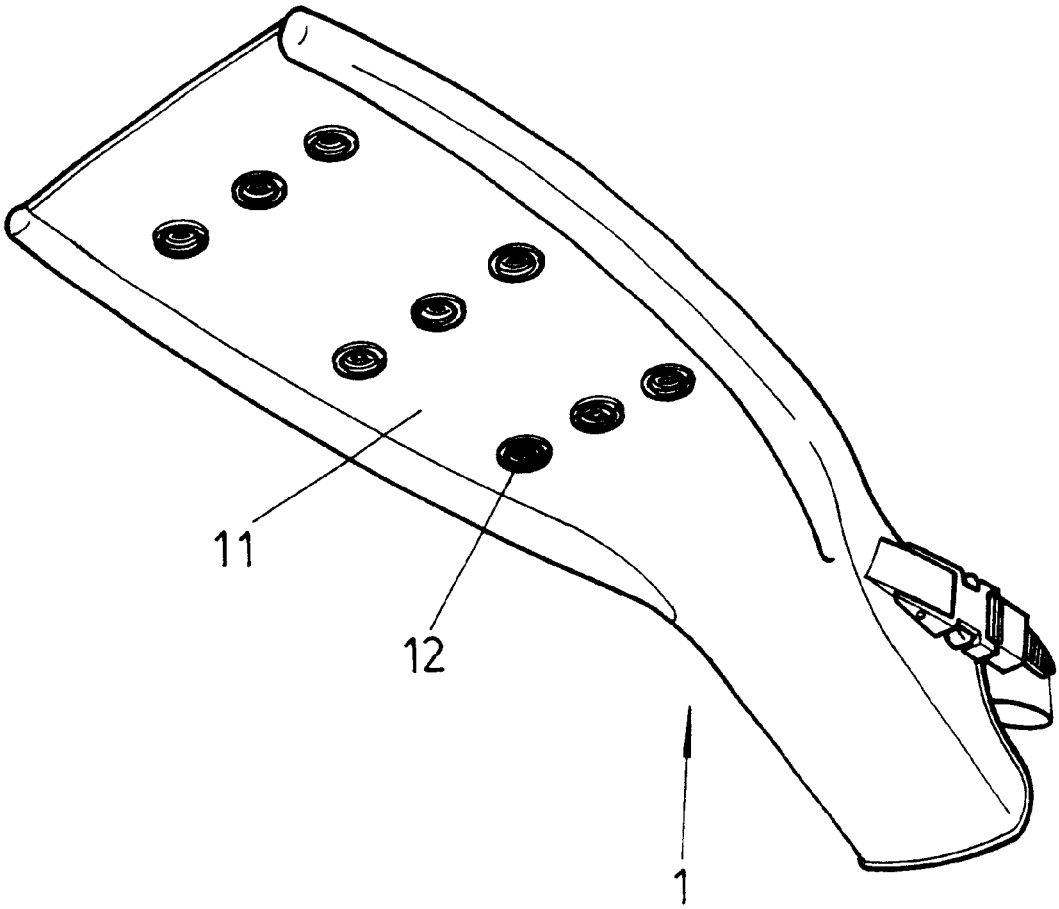
FIG. 1 is a perspective view showing the fin constructed in accordance with the present invention.
Figure 2:
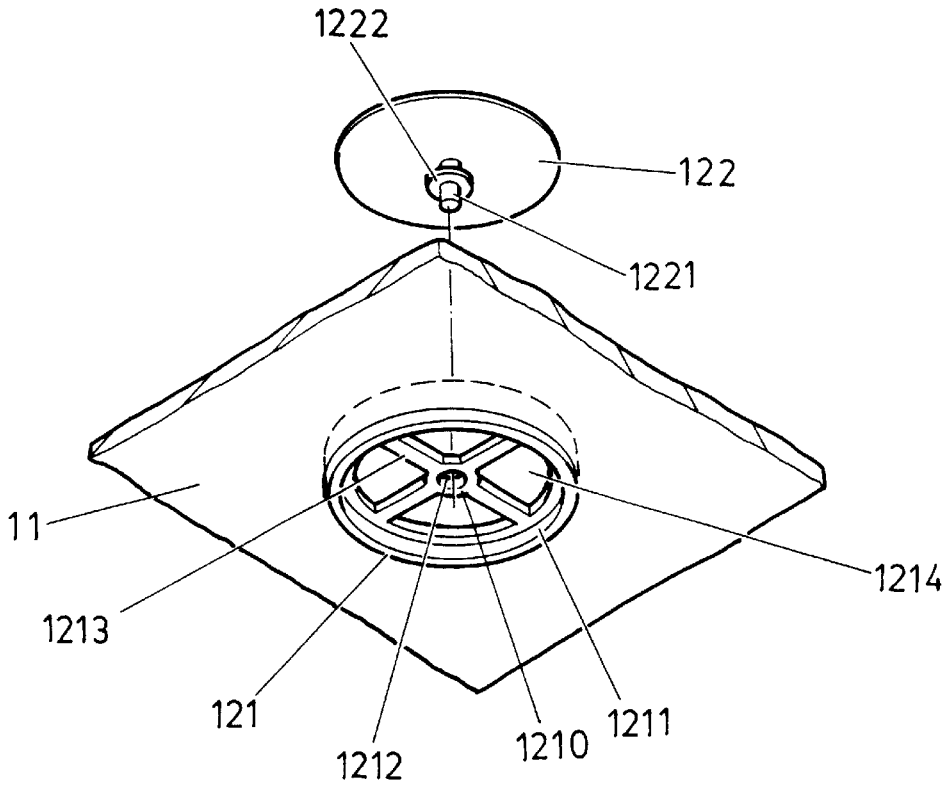
FIG. 2 is an exploded perspective view showing the unidirectional valve in accordance with the present invention.

Referring to FIG. 1 and FIG. 2, a swimming fin (1) constructed in accordance with the present invention has at least one set (nine sets are provided in this embodiment) unidirectional valves (12) mounted on a front portion (11) of the swimming fin (1).

The unidirectional valve (12) has a valve seat (121) integrally formed with the front portion (11) and a resilient-material-made disk (122) detachably engaged with the valve seat (121). The valve seat (121) has a through hole (1211) defined through the front portion (11), multiple ribs (1213) radially extending out from a joint of the ribs (1213) and an opening (1212) defined in the joint of the ribs (1213). With the ribs (1213) extending radially outward inside the through hole (1211), the through hole (1211) is defined into multiple exits (1214). The disk (122) has a stub (1221) extending outward from the disk (122) to correspond to the opening (1212) and a stop (1222) formed on top of the stub (1221) to detachably engage with a periphery defining the opening (1212) to limit the travel of the disk (122).

Figure 3:
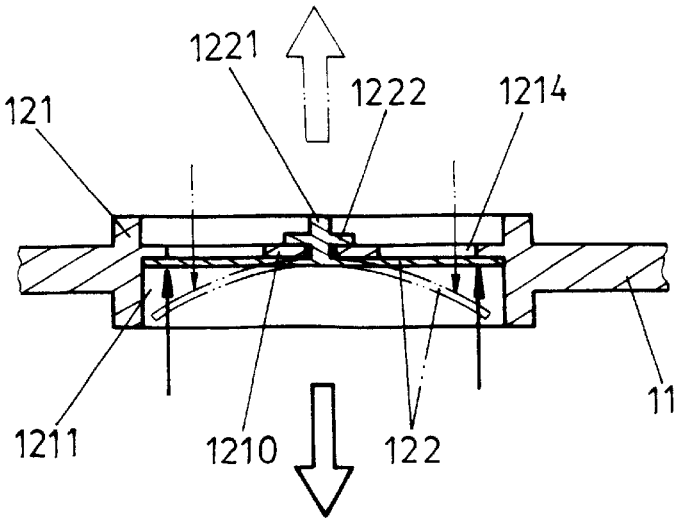
FIG. 3 is a schematic view showing the operation of the unidirectional valve of the invention.

With reference to FIG. 3, when the unidirectional valve of the invention is assembled, the disk (122) abuts an underside of a flange (1210) formed on an inner periphery of the through hole (1211) and the stop (1222) engages a top face of the joint of the ribs (1213) with the stub (1221) extending through the opening (1212) of the joint of the ribs (1213). The size of the disk (122) is so configured that when the disk (122) is snugly fitted in the through hole (1211), the disk (122) seals the through hole (1211).

With this arrangement, when the user paddles downward as shown in arrow A in FIG. 3, the water pressure keeps the disk (122) abut the underside of the flange (1210) so that water can not flow through the through hole (121 1). The user is able to gain the forward force by paddling. However, when the user paddles upward as shown in arrow B in FIG. 3, the water pressure presses down the disk (122) to deform the disk (122), thus water is able to flow through the exits (1214). The user is able to reduce the water resistance against the movement of the fin, such that the user is able to save energy while the fins are paddling upward.

Figure 4:
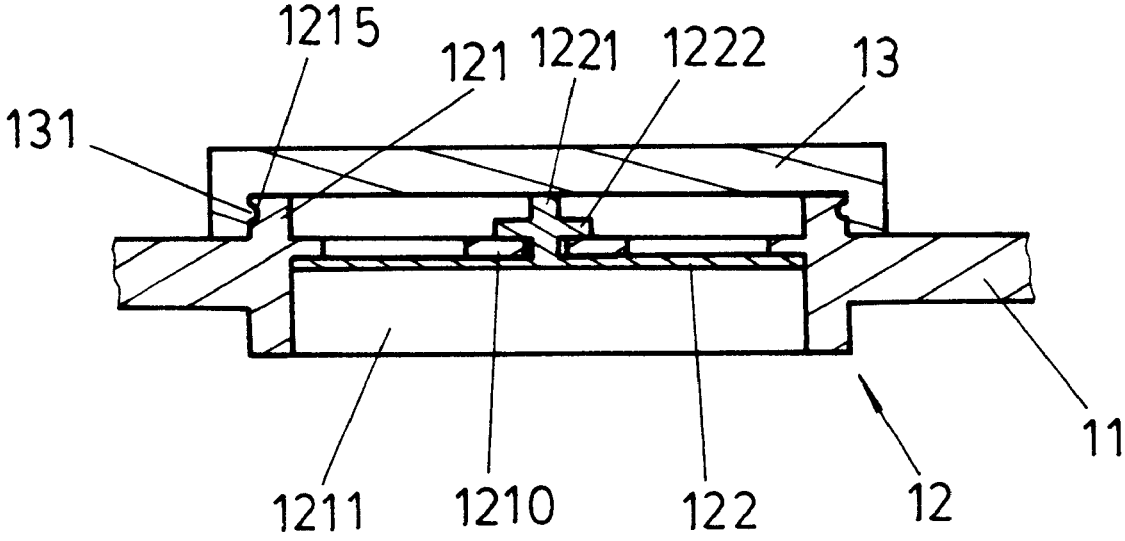
FIG. 4 is a cross sectional view showing another embodiment of the unidirectional valve of the invention.
Figure 6:
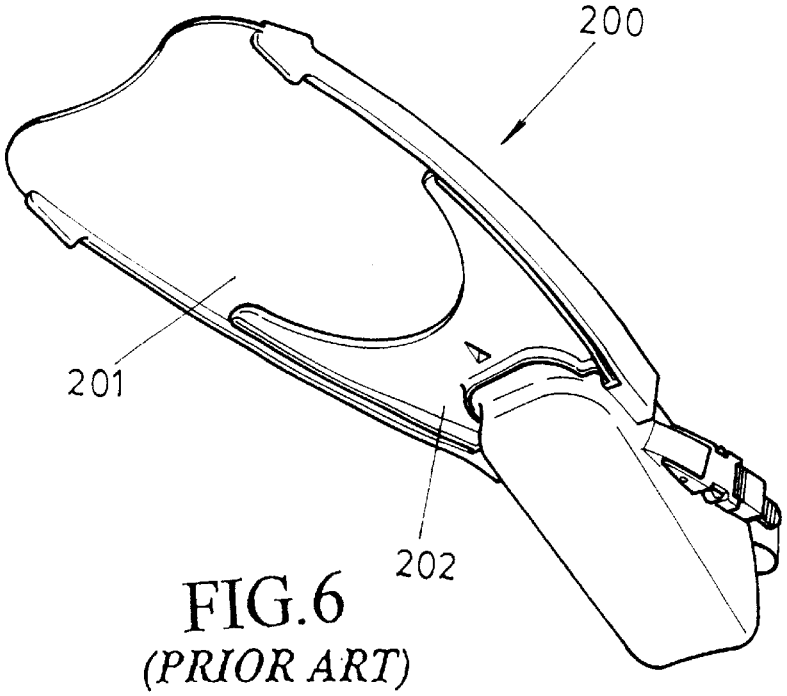
FIG.6 (PRIOR ART)
FIG. 6 is a perspective view showing still another conventional swimming fin.
Figure 5:
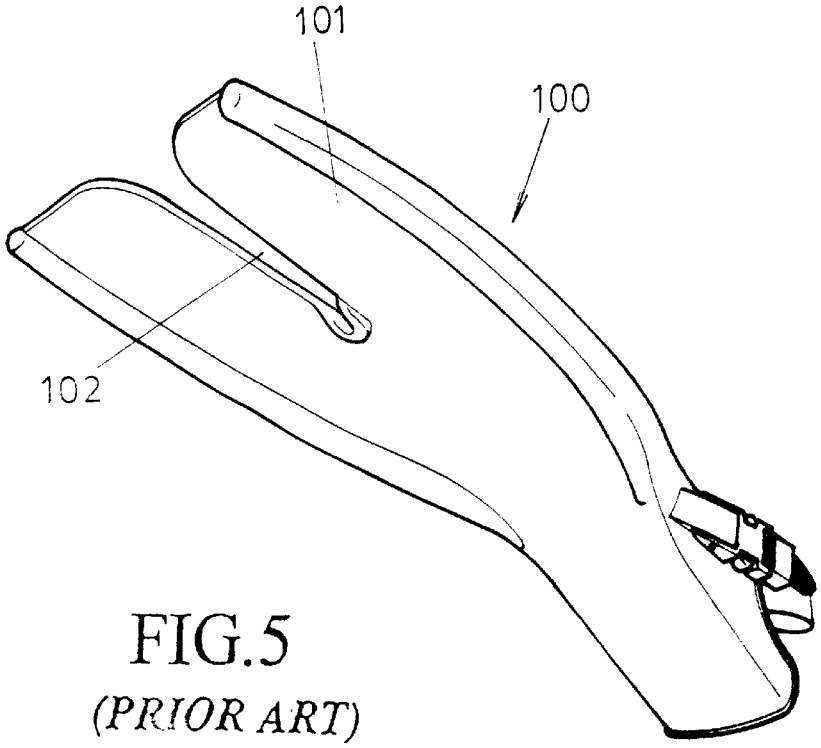
FIG.5 (PRIOR ART)
FIG. 5 is a perspective view showing a conventional swimming fin.

With reference to FIG. 4, because different users have different body strength, a cap (13) is able to be selectively mounted on top of the through hole (1211) to close the through hole (1211), such that the user is able to adjust the water resistance according to his/her own strength. The preferred embodiment is that a cutout (1215) is defined in an outer periphery defining the through hole (1211) and the cap (13) has a annular key (131) formed on an inner face thereof to correspond to the cutout (1215). Thus, when the user uses the cap (13) to close the through hole (1211), the user simply closes the through hole (1211) by placing the cap (13) on top of the through hole (1211) with the annular key (131)

received in the corresponding cutout (1215). Therefore, the through hole (1211) is temporarily closed for increasing the forward force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A unidirectional valve adapted to a swimming fin comprising:

a valve seat configured to be integrally formed with a front portion of the fin and having a through hole defined through the front portion of the fin, multiple ribs radially extending inside the through hole from a joint of the ribs and an opening defined in the joint of the ribs; and a resilient-material-made disk detachably engaged with an underside of the joint of the valve seat to selectively seal the through hole and having a stub extending outward from the disk to correspond to the opening and a stop formed on top of the stub to detachably engage with the joint to limit the travel of the disk.

2. The valve as claimed in claim 1 further comprising a cap selectively mounted on top of the through hole to seal the through hole.

3. A unidirectional valve adapted to a swimming fin comprising:

a valve seat configured to be integrally formed with a front portion of the fin and having a through hole defined through the front portion of the fin, multiple ribs radially extending inside the through hole from a joint of the ribs, an annular flange formed on an inner periphery defining the through hole and an opening defined in the joint of the ribs; and a resilient-material-made disk detachably engaged with an underside of the flange of the valve seat to selectively seal the through hole and having a stub extending outward from the disk to correspond to the opening and a stop formed on top of the stub to detachably engage with a joint of the ribs to limit the travel of the disk.

4. The valve as claimed in claim 3 further comprising a cap selectively mounted on top of the through hole to seal the through hole.

* * * * *